US008267257B2

(12) United States Patent
Doyal

(10) Patent No.: US 8,267,257 B2
(45) Date of Patent: Sep. 18, 2012

(54) TURNTABLE OVEN RACK

(75) Inventor: Timothy P. Doyal, Goodlettsville, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 919 days.

(21) Appl. No.: 11/684,107

(22) Filed: Mar. 9, 2007

(65) Prior Publication Data

US 2008/0217266 A1 Sep. 11, 2008

(51) Int. Cl.
*A47F 3/08* (2006.01)

(52) U.S. Cl. ..... 211/1.52

(58) Field of Classification Search ..... 211/1.52, 211/144, 131.1, 200, 202, 195, 85, 182; 108/94, 108/95; 312/305, 307; 248/164, 298.1; 271/73; 403/154

See application file for complete search history.

(56) References Cited

U.S. PATENT DOCUMENTS

| | | | | | |
|---|---|---|---|---|---|
| 1,350,330 | A * | 8/1920 | Partonnar | 126/338 |
| 1,470,217 | A * | 10/1923 | Claus | 108/20 |
| 1,530,226 | A * | 3/1925 | Bitney | 126/338 |
| 1,653,323 | A * | 12/1927 | Taylor | 108/20 |
| 1,676,108 | A * | 7/1928 | Novak | 108/20 |
| 2,403,164 | A * | 7/1946 | Ahrens et al. | 211/153 |
| 3,012,554 | A * | 12/1961 | Hirsch | 126/338 |
| 4,191,437 | A * | 3/1980 | Funke | 312/305 |
| 4,334,482 | A * | 6/1982 | Bolduc | 108/95 |
| 4,762,237 | A * | 8/1988 | Newton | 211/115 |
| 5,277,488 | A * | 1/1994 | Cleary et al. | 312/408 |
| 5,796,082 | A * | 8/1998 | Kim | 219/752 |
| 6,196,400 | B1 * | 3/2001 | Alneng | 211/144 |

FOREIGN PATENT DOCUMENTS

| | | | |
|---|---|---|---|
| DE | 9316635 | U1 | 2/1994 |
| EP | 0092792 | A | 11/1983 |
| EP | 0594073 | A | 4/1994 |
| WO | 2005006814 | A | 1/2005 |
| WO | 2005047774 | A | 5/2005 |

OTHER PUBLICATIONS

International Search Report for PCT/US2008/055991 dated May 30, 2008, 2 pages.

* cited by examiner

*Primary Examiner* — Sarah Purol
(74) *Attorney, Agent, or Firm* — Pearne & Gordon LLP

(57) ABSTRACT

A rack for an appliance is provided. The rack includes a main support platform having a first support frame, an auxiliary support platform having a second support frame, and a plurality of elongated support members attached to the second support frame to form an auxiliary support surface. The auxiliary support platform is rotatable relative to the main support platform. In one example, the auxiliary support platform is rotatably connected to the main support platform. In addition or alternatively, a rotational drive member is operatively attached to the main support platform and operatively attached to the auxiliary support platform for causing rotational movement of the auxiliary support platform relative to the main support platform. Further, an appliance is provided including a main body having an interior cavity bounded by at least one wall section, and the main support platform is configured to be supported within the interior cavity.

14 Claims, 5 Drawing Sheets

TURNTABLE OVEN RACK

RELATED APPLICATIONS

Not Applicable.

BACKGROUND OF THE INVENTION

1) Field of the Invention

The present invention relates to racks for appliances, and more particularly, to a turntable rack for an oven.

2) Description of Prior Art

Ovens often have one or more racks generally within the oven. The racks are useful for the placing of cookware, food, and other items, within the oven. The racks place the cookware generally towards the middle of the oven, and keep the cookware away from heating elements and the like. In addition, ovens with multiple racks allow for placement of cookware on a variety of levels within the oven, thereby increasing the total volume of available cooking space.

The racks are often supported by ledges formed along the inner walls of the oven. The racks are then movable in and out of the oven on the ledges. This allows the racks to be removed from the oven for cleaning or for other purposes. Often, the racks may be partially removed from the oven so as to allow easier access to items placed on the racks. The ledges also facilitate vertical adjustment of the racks within the oven cavity.

Oven racks are often of wire form construction. More specifically, an outer wire frame and a support platform, which is constituted by a plurality of fore-to-aft and laterally spaced wires, define a typical oven rack. The wires are substantially evenly spaced across the entire rack for use in supporting food items to be cooked.

BRIEF SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In accordance with an aspect of the present invention, a rack for an appliance is provided. The rack includes a main support platform having a first support frame and a plurality of elongated support members attached to the first support frame to form a main support surface. The rack also includes an auxiliary support platform having a second support frame and a plurality of elongated support members attached to the second support frame for form an auxiliary support surface. The auxiliary support platform is rotatably connected to the main support platform to permit rotational movement of the auxiliary support platform relative to the main support platform.

In accordance with another aspect of the present invention, a rack for an appliance is provided. The rack includes a main support platform having a first support frame, an auxiliary support platform having a second support frame, and a plurality of elongated support members attached to the second support frame for form an auxiliary support surface. The rack also includes a rotational drive member operatively attached to the main support platform and operatively attached to the auxiliary support platform for causing rotational movement of the auxiliary support platform relative to the main support platform.

In accordance with another aspect of the present invention, an appliance is provided. The appliance includes a main body having an interior cavity bounded by at least one wall section, a main support platform configured to be supported within the interior cavity, and an auxiliary support platform having a second support frame and a plurality of elongated support members attached to the second support frame for forming an auxiliary support surface. The appliance also includes an electric motor attached to the at least one wall section, and a drive element operatively connected to both of the electric motor and the auxiliary support platform. The electric motor causes rotational movement of the drive element for causing rotational movement of the auxiliary support platform relative to the main support platform.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
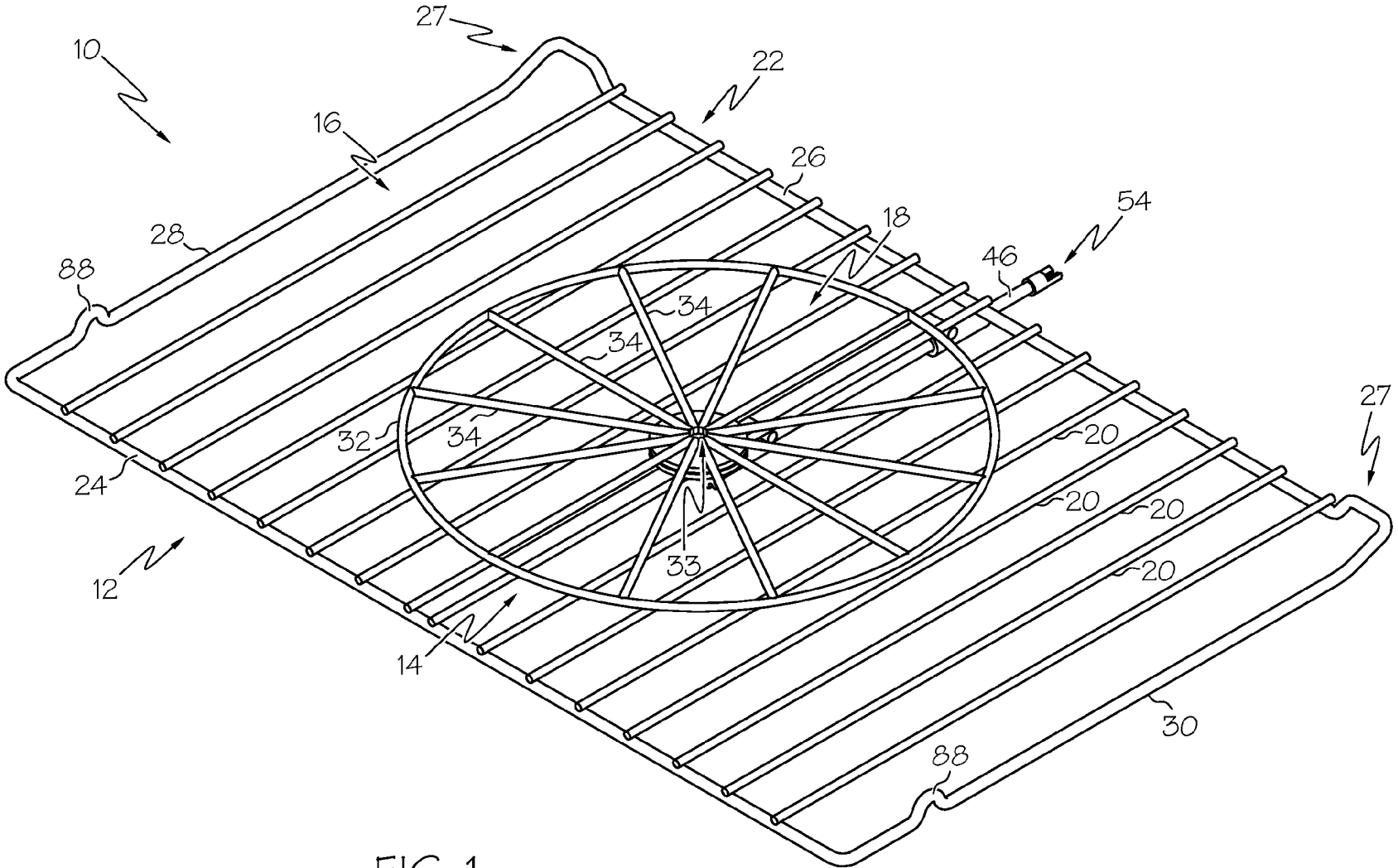
FIG. 1 illustrates a perspective view of an example turntable rack for an appliance in accordance with an aspect of the present invention.

The present invention relates to a turntable rack for an oven. The present invention will now be described with reference to the drawings, wherein like reference numerals are used to refer to like elements throughout. It is to be appreciated that the various drawings are not necessarily drawn to scale from one figure to another nor inside a given figure, and in particular that the size of the components are arbitrarily drawn for facilitating the understanding of the drawings. In the following description, for purposes of explanation, numerous specific details are set forth in order to provide a thorough understanding of the present invention. It may be evident, however, that the present invention may be practiced without these specific details.

Figure 2:
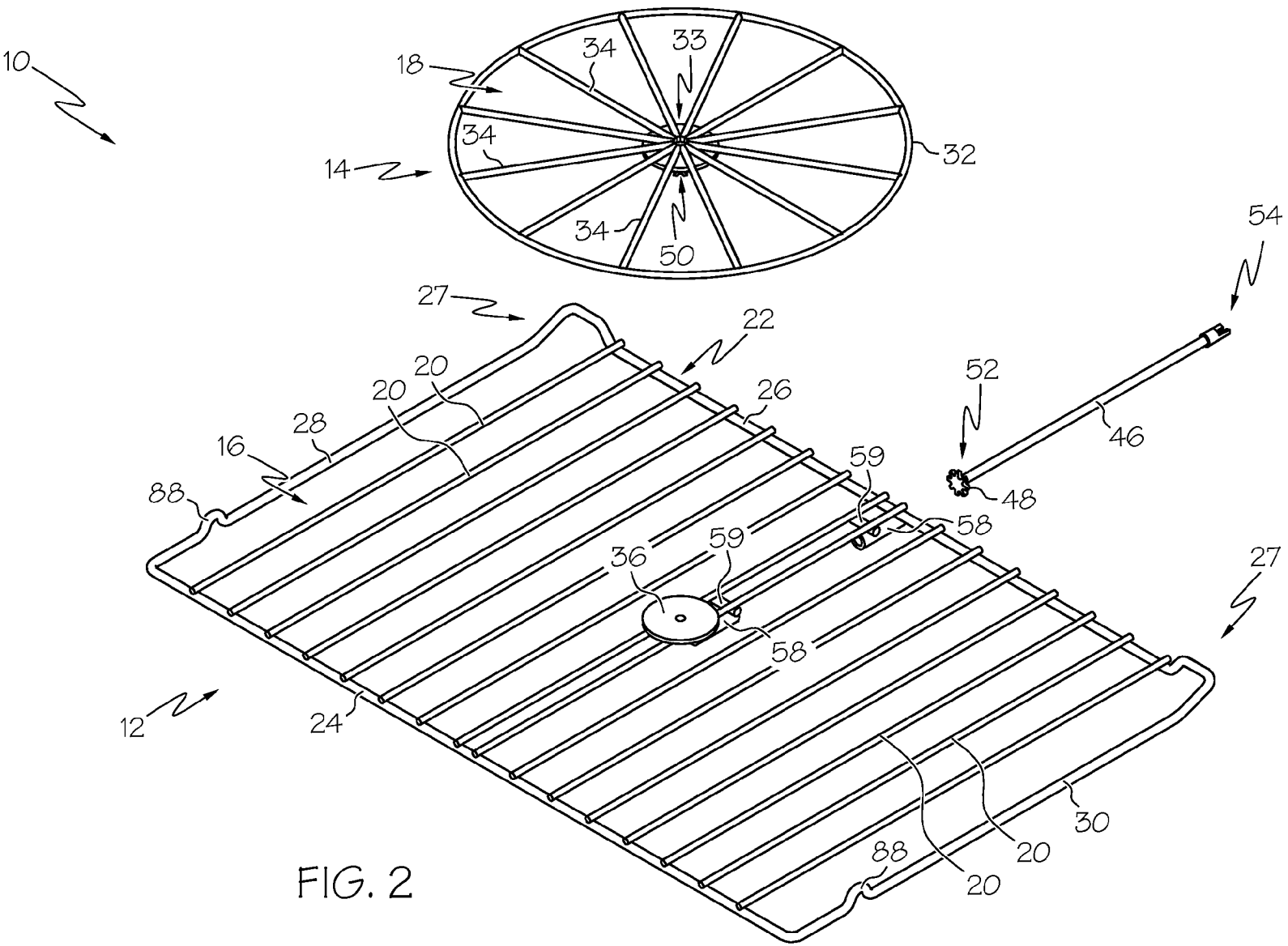
FIG. 2 is similar to FIG. 1, but shows an exploded view.

Referring initially to FIGS. 1 and 2, an example of a rack 10 for an appliance, such as an oven, refrigerator, or freezer is illustrated in accordance with an aspect of the present invention. The rack 10 includes a main section 12 and an auxiliary section 14. As shown, the auxiliary section 14 can be relatively smaller than the main section 12 (e.g., occupying a partial area of the rack 10). Both the main section 12 and the auxiliary section 14 can be constructed from metal wire, such as iron coated with nickel or steel coated with porcelain. However, it is to be appreciated that either, or both of the main section 12 and the auxiliary section 14 can be constructed from various other suitable materials (e.g., aluminum, sheet metal, or the like). Moreover, it is to be appreciated that the main section 12 can be constructed from a first material and the auxiliary section 14 can be constructed from a second different material. The auxiliary section 14 is adapted to be rotatably connected to the main section 12, as will be discussed more fully herein.

The main section 12 can include a main support platform 16, and the auxiliary section can include an auxiliary support platform 18. The rack 10 can include a support frame 22, and a plurality of elongated support bars 20 can extend across the support frame 22 to form the main support platform 16. As shown, the frame 22 can include a front bar 24, rear bar 26, and apposed side bars 28, 30 that can be attached together to form the support frame 22 in various manners, such as by welding, adhesives, or fasteners, and/or can even be formed from a single piece of wire. The elongated support bars 20 can extend between the front bar 24 and the rear bar 26, though it is to be appreciated that the support bars 20 can also be oriented in various manners.

As shown, the support frame 22 can have a generally rectangular geometry, though it is to be appreciated that the support frame 22 can also have various other geometries. Additionally, as shown, a portion of the support frame near the intersection of the rear bar 26 and the apposed side bars 28, 30 can be angled upwardly at a relatively higher position with respect to the front bar 24 to act as a stop 27 to limit the extent to which the rack 10 can be removed from an oven cavity. For example, the stop 27 can inhibit the rack 10 from being inadvertently removed from, or falling out of, an oven cavity.

Further, though not shown, the rack 10 can include one or more cross members or strengthening members (not shown) provided across a portion of the main support platform 16 to provide strength thereto. The cross member(s) can operate to mitigate sagging of the main support platform 16 with respect to the front bar 24 when heavy food, cookware, or the like (not shown) is placed on the main support platform 16. Sagging of the main support platform 16 can present problems with easily sliding the food or cookware from the main support platform 16 without interference from the front bar 24. The ends of the support members 20 and/or the cross member(s) can be welded (e.g., spot welded), otherwise secured to, or even formed together as a single unit with, the various portions of the rack 10. Further, the support members 20, frame 22, and/or cross member(s) can be manufactured from metal wire or any other suitable material which provides adequate strength to support items such as cake pans, pizza stones and casseroles, or the like, and withstands the heat of an oven. As can be appreciated, the cross member(s) can be oriented in various other manners, including transverse or angled relative to the elongated support members 20.

As previously mentioned, the rack 10 also includes an auxiliary section 14 having an auxiliary support platform 18. The auxiliary section 14 can be adapted to be rotatably connected to the main section 12 to permit rotational movement of the auxiliary support platform 18 relative to the main support platform 16. The auxiliary section 14 is adapted to support various items, such as cookware, food, and other items, within the oven. Further, the auxiliary section 14 can be adapted to support various items independent of the orientation of the auxiliary support platform 18 relative to the main support platform 16 (e.g., the relative angle of the auxiliary support platform 18 with respect to the main support platform 16).

Further, the auxiliary support platform 18 can include an auxiliary support frame 32 having at least one elongated support member 34. As shown, the auxiliary support frame 32 (and the auxiliary support platform 18) can have a generally circular geometry, though it is to be appreciated that it can also have various other geometries, such as square, rectangular, triangular, oval or elliptical, polygonal, etc. Further, as shown, the elongated support members 34 can extend radially outwards from a generally central area 33 to the edge of the auxiliary support frame 32 to form the auxiliary support platform 18. It is to be appreciated that the elongated support members 34 can also be arranged in various other manners, such as extending substantially parallel to each other across the auxiliary support frame 32.

Additionally, similar to the main section 12, the auxiliary section 14 can also include one or more cross member(s) or strengthening member(s) (not shown) provided across a portion of the auxiliary support platform 18 provide additional strength. As with the main section 12, the cross member(s) can operate to mitigate sagging of the auxiliary support platform 18 with respect to the auxiliary support frame 32 when heavy food, cookware, or the like is placed on the auxiliary support platform 18. The ends of the support member(s) and/or the cross member(s) can be welded (e.g., spot welded), otherwise secured to, or even formed together as a single unit with, the various portions of the auxiliary section 14. Further, the support member 34, auxiliary support frame 32, and/or any cross member(s) can be manufactured from metal wire or any other suitable material which provides adequate strength to support items such as cake pans, pizza stones and casseroles, or the like, and withstands the heat of an oven.

As stated previously, the auxiliary section 14 can be adapted to rotatably connect to the main section 12 for permitting rotation of the auxiliary support platform 18 relative to the main support platform 16. In one example, the auxiliary section 14 can be rotatably connected to the main section 12 by way of a rotational support 36, such as a bushing, a bearing (as shown), or the like. Various types of bearings can be used, such as ball bearings, roller bearings, spindle bearings, thrust bearings, sleeve bearings, fluid bearings, or the like. Thus, for example, the bearing can permit passive rotation of the auxiliary section 14 relative to the main section 12 when an outside force, such as might be provided by the hand of a user, is imparted to the auxiliary section 14.

Figure 3:
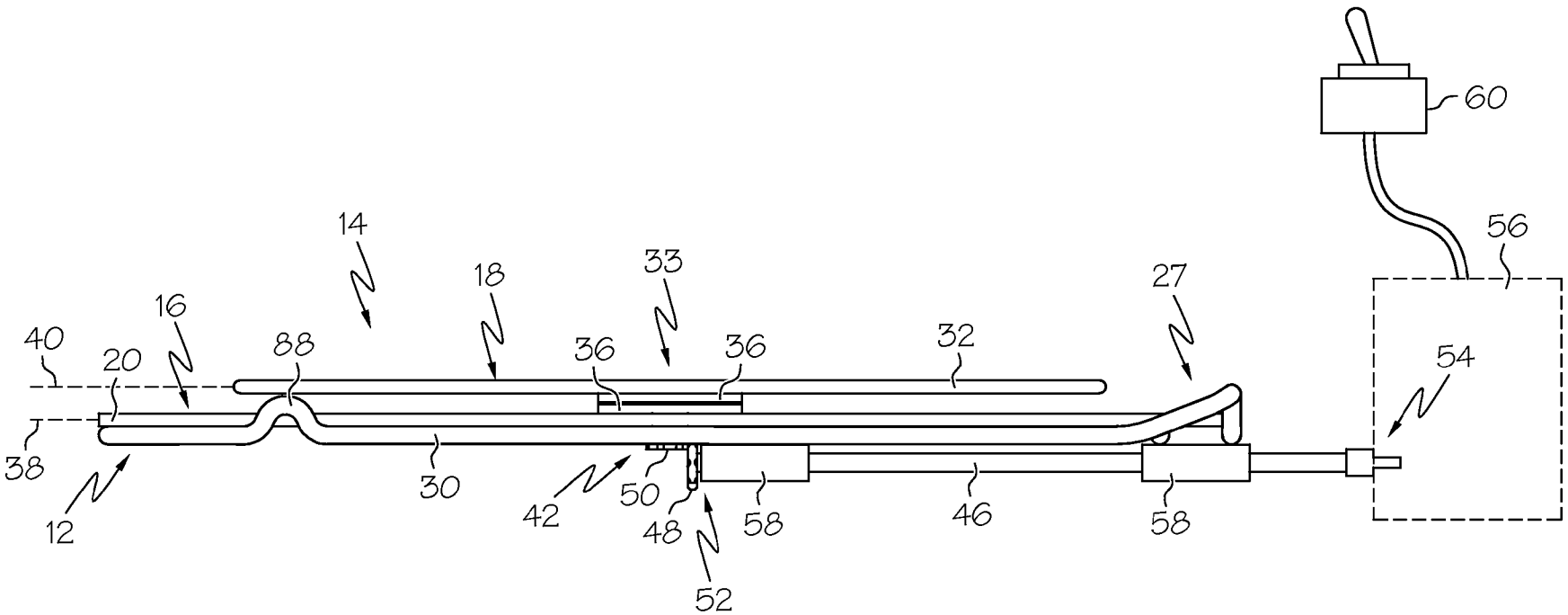
FIG. 3 is similar to FIG. 1, but shows a side view.

Additionally, the rotational support 36 can maintain a planar orientation of the auxiliary section 14 relative to the main section 12. For example, as shown in FIG. 3, the support members 20 of the main support platform 16 can extend substantially parallel to each other such that the main support platform 16 extends substantially along a first plane 38. Similarly, the support frame 32 and the attached support members 34 of the auxiliary support platform 18 can be arranged such that the auxiliary support platform 18 extends substantially along a second plane 40. Thus, the rotational support 36 can be configured to maintain the second plane 40 generally parallel to the first plane 38 during rotation of the auxiliary section 14 relative to the main section 16.

Figure 4:
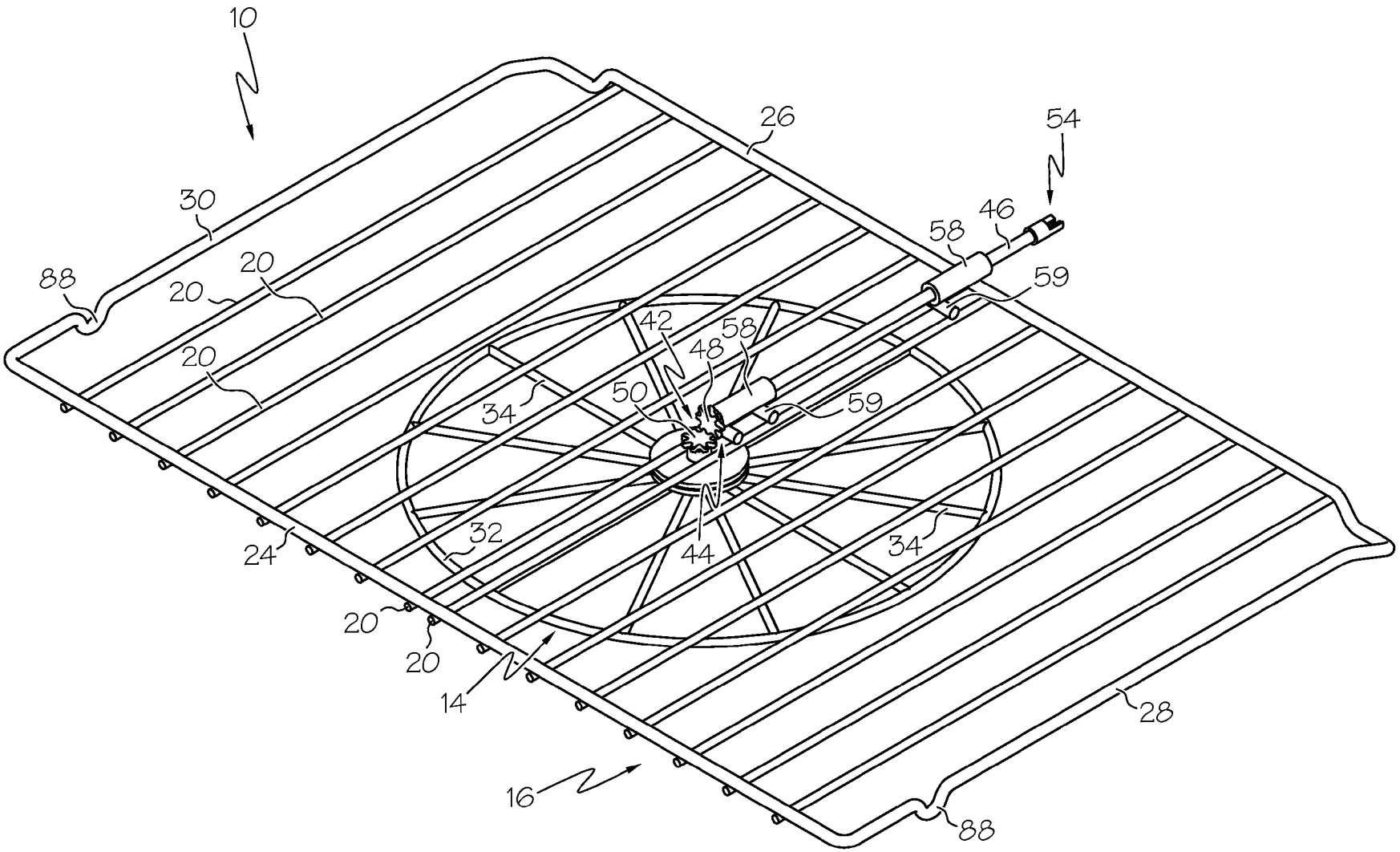
FIG. 4 is similar to FIG. 1, but shows a bottom perspective view.

Turning now to the example shown in FIG. 4, the auxiliary section 14 can be adapted to rotatably connected to the main section 12 by way of a rotational drive member operatively attached to both of the main support platform 16 and the auxiliary support platform 18. In one example, the rotational drive member can include a gearbox 42 for transferring a motive force to the auxiliary section 14 to cause rotation thereof. It is to be appreciated that, shown in FIG. 4, a protective covering for the gearbox 42 have been removed for the sake of clarity. However, a protective covering, either removable or non-removable, can be used around the gearbox 42 to protect a user from potential harm.

As shown, the gearbox 42 can include a gear assembly 44 or the like for transferring a motive force from a drive element 46 to the auxiliary support platform 18. For example, as shown, the gear assembly 44 can include an input gear 48 operatively connected to the drive element 46, and an output gear 50 operatively connected to the auxiliary support platform 18. Thus, the gear assembly 44 can be configured to transfer a motive force from the input gear 48 to the output gear 50. As shown, both of the input and output gears 48, 50 can be spur gears configured to transfer a motive force over approximately 90°, though it is to be appreciated that various types of gear assemblies can be used to transfer a motive force over various angles. For example, the gear assembly 44 can include helical or spiral gears, worm gears, bevel gears, crown gears, differential gears, rack and pinion gears, and/or planetary gears.

Additionally, the gear assembly 44 can include various numbers of gears, such as the addition of idler gears or the like. Further still, the gear assembly 44 can also be configured to alter a rotational speed and/or torque provided by the input gear 48. For example, the gear ratio between the input and output gears 48, 50 can be configured so as to increase and/or decrease the rotational speed and/or the torque provided between the input gear 48 and the output gear 50. Even further still, the gearbox 42 and/or gear assembly 44 can include various other non-traditional gearing configurations, alone or together with the aforementioned gear assemblies 44, such as a belt, pulley, and/or chain driven configuration. It is to be appreciated that various lubricants, such as grease or the like, can be used with the gearbox 42, gear assembly 44 and/or other non-traditional gearing configurations.

Returning briefly to FIG. 3, as mentioned, the gearbox 42 can transfer a motive force from a drive element 46 to the auxiliary support platform 18. As shown, the drive element 46 can include a rod or the like (e.g., solid or hollow) having a first end 52 operatively connected to the gearbox 42, such as by way of the input gear 48. For example, the first end 52 of the drive element 46 can be releasably (e.g., by way of a keyed shaft, interference fit, fasteners, pins, etc.) or non-releasably (e.g., by way of welding, adhesives, being formed with, etc.) connected to the input gear 48. It is to be appreciated that similar or different attachment methods can be used to releasably or non-releasably connect the output gear 50 to the auxiliary support platform 18.

Additionally, the drive element can include a second end 54 configured to be connected to a driving apparatus, such as an electric motor 56 (shown in phantom). For example, the second end 54 can include a keyed drive shaft or the like configured to releasably or non-releasably engage the electric motor 56 in any of the manners previously described in relation to the first end 52. The second end 54 can be directly connected to the electric motor 56, or can also be indirectly connected by way of an additional gearbox, linkage, or the like. Further, the rack 10 can include support structure for supporting the drive element 46. For example, as shown, the drive element 46 can be rotatably supported by one or more rotational supports 58 attached to the main section 12 of the rack 10. The rotational supports 58 can include various bushing, bearings, or the like. As shown, the rotational supports 58 can be removably or non-removably attached to the main section 12 in various manners, such as by way of cross supports 59 or the like attached to the elongated support members 20. Further, as shown, the elongated support members 20 can be spaced relatively closer together to facilitate attachment of the cross supports 59 and/or the rotational supports 58. In addition or alternatively, the drive element 42 can be housing within a hollow, outer tube or shell (not shown) for providing protection and/or heat insulation. Various lubricants, such as grease or the like, can be used with any or all of the bearings discussed herein.

The electric motor 56 can be of various types, such as various types of AC or DC electric motors 56. The electric motor 56 can be configured to impart a rotational driving motion to the drive element 46, so as to eventually (e.g., through the gearbox 42) cause the auxiliary section 14 (and the auxiliary support platform 18) to rotate relative to the main section 12. Where the rotatable rack 10 is used in an appliance, the electric motor 56 can be electrically connected to the appliance to receive electric current therefrom, though it can also receive electric current from an independent source as well. Further, electric motor 56 and/or the appliance can include a switch 60 operatively connected to the electric motor 56 for selectively turning the motor 56 "on" and "off". In addition or alternatively, the switch 60 (or even another switch) can be used to vary the rotational speed of the motor 56 to thereby vary the rotational speed of the auxiliary support platform 18. In addition or alternatively, the switch 60 (or another switch) can be used to vary the operational time of the motor 56 to thereby vary the operational time that the auxiliary support platform 18 rotates. For example, the motor 56 can remain "on" for a predetermined time, can be turned "off" after a predetermined time, can be cycled "on" and "off" for predetermined times. Further still, the electric motor 56 can be programmed (e.g., via analog or digital timing means) to be turned "on" and "off," or even be programmed to have varying speeds at varying times, according to a predetermined program. The switch(es) 60 and/or supporting components (e.g., timing means, programming elements, etc.) can be connected to the appliance, and/or can even be incorporated into a central operating panel for the appliance.

The rack 10 can also include various additional structure. In one example, where a motor 56 or the like is used to drive the rotation of the auxiliary section 14, the rotational support 36 can be replaced with a hub or the like attached to either or both of the main and auxiliary sections 12, 14 for maintaining the second plane 40 generally parallel to the first plane 38 during rotation of the auxiliary section 14. For example, as shown in FIG. 3, both of the main and auxiliary sections 12, 14 can each have a hub 36.

In another example, the rotational drive member that rotatably connects the auxiliary section 14 to the main section 12 can include an electric motor (not shown) attached to either, or both, of the main and auxiliary sections 12, 14. In such an example, the electric motor can directly or indirectly drive the rotation of the auxiliary section 14, and as such may or may not include a gearbox or the like as previously discussed herein. Power can be supplied to the electric motor in various manners, such as through a removable connection to a power supply provided by the appliance (e.g., such as through a connection provided in a wall of the appliance). Alternatively, the motor can be battery powered.

In yet another example, the auxiliary platform 14 can include a handle portion (not shown) adapted to facilitate movement of the main section 12 relative to an appliance, such as for insertion and/or removal from an oven. The handle can be formed of a similar material as the main rack 12 (e.g., metal wire or the like) and can be attached to (e.g., welding or the like), or even formed with, the front bar 24 of the main section 12. The handle can be configured to be grasped to a hand of a user, and can include various coatings and/or a covering member (e.g., silicone, porcelain, ceramic, or the like) adapted to insulate a user's hand from the heat of an oven.

Further still, the auxiliary section 14 can be adapted to be removable from the main section 12. For example, the auxiliary section 14 can be completely removed from the main section 12 such that the main section can remain within an oven while the auxiliary section 14 is removed therefrom. For example, when the auxiliary section 14 is removed from the main section 12, various items (e.g., cookware, items to be cooked, etc.) can be supported directly by the main support platform 16. With the auxiliary section 14 removed, the main section 12 can support relatively larger cookie sheets or casserole dishes, or the like. Since the auxiliary section 14 is relatively small and light, its removal from the main rack can be readily accomplished with little effort. In one example, the auxiliary section 14 can be removed from the main section 12 by releasing a lock, latch, or the like, though other methods of removal are also contemplated. In another example, the auxiliary section 14 can include a keyed drive shaft or the like configured to releasably engage with the gearbox 42. It is to be appreciated that the various additional features discussed herein are not intended to provide any limitation upon the present invention, and that modification of the features and or the addition of other features are contemplated to be within the scope of the invention.

Figure 5:
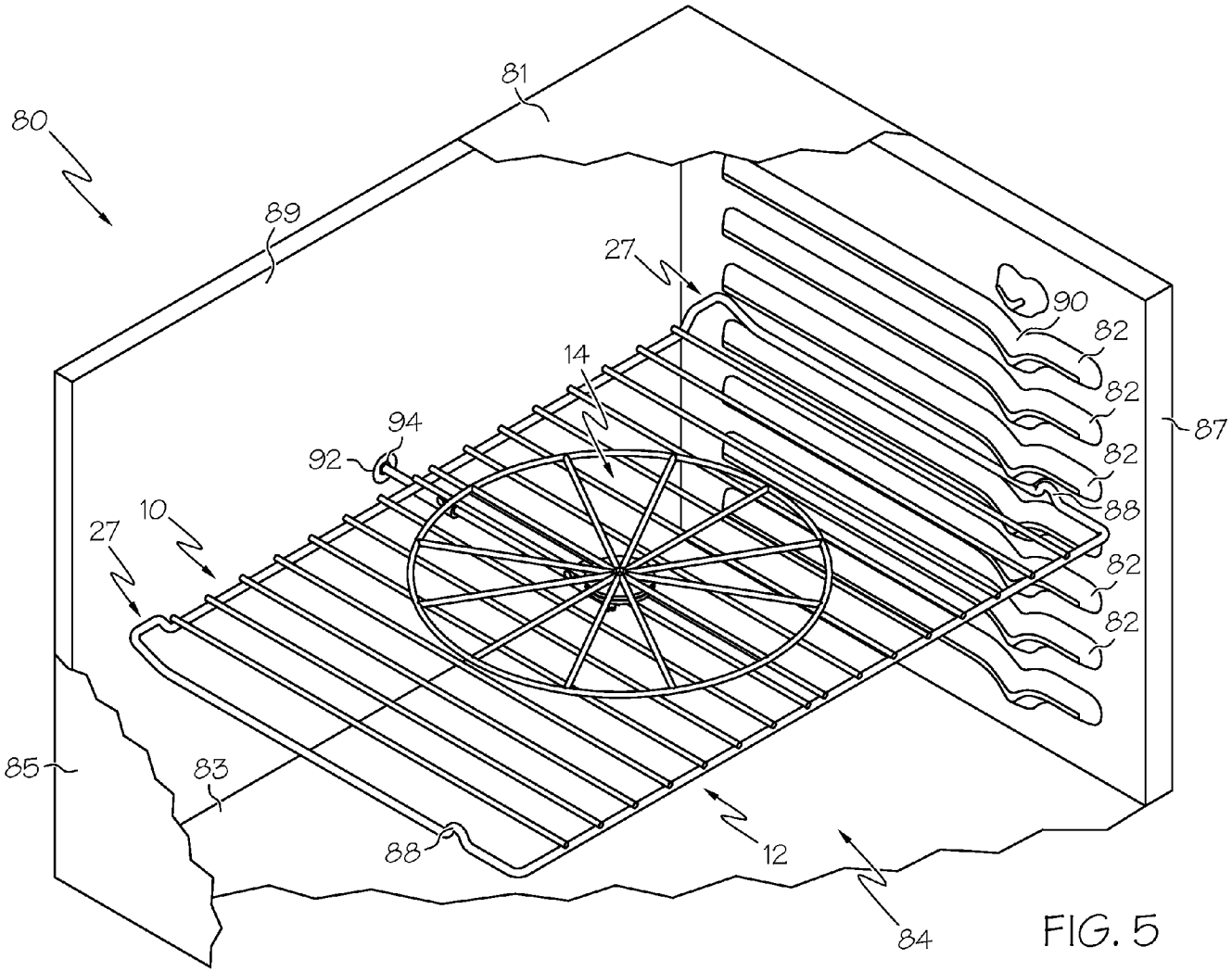
FIG. 5 illustrates the turntable rack of FIG. 1 mounted within an oven environment in accordance with another aspect of the present invention.

Turning now to FIG. 5, the rack 10 of the present invention is illustrated employed within an oven environment 80. Thus, as shown, the support frame 22 of the main section 12 can be supported by guide rails 82 within an interior cavity 84 of the oven 80. The interior cavity 84 is bounded by at least one wall section. As shown, the interior cavity 84 can be bounded by five wall sections, namely, a top wall 81, bottom wall 83, apposed side walls 85, 87, and a rear wall 89. A sixth wall can be completed by an oven door (not shown) that can be opened and closed to selectively permit access to the interior cavity 84. The guide rails 82 can be located on the apposed side walls 85, 87.

As previously described, the main section 12 can include an upwardly-facing stop 27 integrally formed in the wire frame of each of the sides 28, 30 of the support frame 22 to facilitate alignment of the rack 10 within the oven 80. As shown, the guide rails 82 of the oven 80 can have corresponding downward-facing projections 90 for engagement with the stops 27 to inhibit inadvertent removal of the rack 10 from the oven 80. Further, the main section 12 of the rack 10 can include upward-facing projections 88 that can be adapted to contact the downward-facing projections 90 of the top guide rails 82 such that an additional stop is created to properly align the main section 12 within the standard rack location of the oven 80.

The electric motor 56 can be attached to one of the wall sections 81, 83, 85, 87, 89. For example, as shown, the motor 56 can be attached to the rear wall section 89. The motor 56 can be located within the interior cavity 84 or, as shown, can be located outside of the cavity 84 and be accessible to the cavity 84 by way of a hole extending through the wall section. For example, a hole 92 can extend through the rear wall 89 through which the drive element 46 can extend for engagement with the motor 56. In addition, as shown in FIG. 5, the drive element 46 can be supported within the hole 92 by a rotational support 94, such as a bushing, bearing, or the like, that can also provide a heat seal for inhibiting heat loss from the interior cavity 84 through the hole 92. Alternatively, the electric motor 56 can be attached to any of the other wall sections 81, 83, 85, 87, and/or may even be attached to the oven door (not shown). It is to be appreciated that the drive element 46, and any supporting structure (e.g., rotational supports 58, 94) can be appropriately modified so as to transfer the motive force from the electric motor 56 to the auxiliary support platform 18. For example, the motor 56 can be attached to either of the side walls 85, 87, or alternatively, to either of the top or bottom walls 81, 83 with the drive element 46 extending therefrom towards the gearbox 42.

Accordingly, with the rack 10 supported within the oven cavity 84, the main support platform 16 of the main section 12 and the auxiliary support platform 18 of the auxiliary section 14 can be utilized to support various items for cooking within the oven. When the electric motor 56 is activated, or when a user applies an external force, such as by a hand of the user, the auxiliary support platform 18 can rotate relative to the main support platform 16. When used in an oven environment 80, rotation of the auxiliary support platform 18 can provide for more even heating of items supported thereon. Thus, heat from the oven cavity 84 can be more evenly distributed to the items being cooked. Further, where the oven 80 is equipped with a broiler element (not shown) attached to an upper wall of the oven cavity 84, the rotation of the auxiliary support platform 18 can provide a more even distribution of the relatively high broiler heat to the items being cooked. In addition or alternatively, rotation of the auxiliary support platform 18 can permit easier access to items located thereon. For example, when a user wishes to view or access a portion of an item located towards the rear wall 89, the user can simply rotate the auxiliary support platform 18 instead of having to remove the main section 12 from the oven cavity 84.

It is to be appreciated that the racks of the subject invention can be used in settings other than in an oven. For example, the racks of the subject invention could be used in a refrigerator and/or freezer unit. Further, it is to be appreciated that the racks can be constructed of any suitable material, such as metal, plastic, and the like. Further still, the frame, the bars, and the cross-member(s) need not be constructed from the same materials.

The size of the frame of the rack of the subject invention also depends upon the intended use of the rack. In the example embodiments, the rack is sized to slide into or replace a rack of a conventional oven. Likewise, the bars are spaced to accommodate cookware. The frame can be made larger to fit commercial ovens or sized to fit any apparatus in which the racks are to be used. The bars of the rack can be spaced appropriately within the frame to hold any designated item.

The invention has been described hereinabove using specific examples; however, it will be understood by those skilled in the art that various alternatives may be used and equivalents may be substituted for elements or steps described herein, without deviating from the scope of the invention. Modifications may be necessary to adapt the invention to a particular situation or to particular needs without departing from the scope of the invention. It is intended that the invention not be limited to the particular implementation described herein, but that the claims be given their broadest interpretation to cover all embodiments, literal or equivalent, covered thereby.

What is claimed is:

1. A rack for a cooking oven, including:

a main support platform having a first support frame; and an auxiliary support platform having a second support frame and a plurality of elongated support members attached to the second support frame to form an auxiliary support surface, the auxiliary support platform being rotatably connected to the main support platform to permit rotational movement of the auxiliary support platform relative to the main support platform, wherein the auxiliary support platform is operatively connected to a drive element to cause rotational movement of the auxiliary support platform, the drive element is supported by a heat seal within an opening of an oven wall, the heat seal configured to inhibit heat loss through the opening, and wherein the drive element is operatively coupled to a switch for selectively turning the drive element on and off independent of the operation of the cooking oven.

2. The rack of claim 1, the auxiliary support platform being rotatably connected to the main support platform by way of a rotational support.

3. The rack of claim 2, wherein the rotational support includes a bearing.

4. The rack of claim 2, wherein the main support platform further includes a plurality of elongated support members attached to the first support frame to form a main support surface.

5. The rack of claim 4, wherein the main support surface is formed along a first plane and the auxiliary support surface is formed along a second plane, the rotational support being configured to maintain the second plane generally parallel to the first plane during rotation of the auxiliary support platform relative to the main support platform.

6. The rack of claim 1, wherein the drive element is operatively connected to the auxiliary support platform by a gearbox having an input operatively connected to the drive element and an output operatively connected to the auxiliary support platform, the gearbox being configured to transfer rotational motion from the drive element to the auxiliary support platform.

7. The rack of claim 1, wherein the drive element is configured to be driven for rotation by an electric motor.

8. The rack of claim 1, wherein the drive element is connected to the main support platform by a rotational support.

9. The rack of claim 1, wherein the main support platform is configured to be supported within an interior cavity of the cooking oven.

10. The rack of claim 1, further including a rotational drive member operatively attached to the main support platform and operatively attached to the auxiliary support platform for causing rotational movement of the auxiliary support platform relative to the main support platform, wherein the rotational drive member includes a gearbox.

11. The rack of claim 10, wherein the drive element is operatively connected to the gearbox.

12. The rack of claim 11, wherein the gearbox includes an input operatively connected to the drive element and an output operatively connected to the auxiliary support platform, the gearbox being configured to transfer rotational motion from the drive element to the auxiliary support platform.

13. The rack of claim 1, further comprising a programmable electric motor to vary the speed of the drive element according to a predetermined program.

14. A method of more evenly cooking food items, the method including:

opening a door of a cooking oven;

placing a rack in the cooking oven, the rack including a main support platform having a first support frame, and an auxiliary support platform having a second support frame and a plurality of elongated support members attached to the second support frame to form an auxiliary support surface, the auxiliary support platform being rotatable connected to the main support platform to permit rotational movement of the auxiliary support platform relative to the main support platform;

placing a food item on the auxiliary support platform;

closing the door of the cooking oven;

actuating a switch, the switch actuates a drive element that is operatively connected to the auxiliary support platform and rotates the auxiliary support platform independently of cooking oven operation; and cooking the food item for a desired time, wherein the drive element is supported by a heat seal within an opening of an oven wall, the heat seal inhibiting heat loss through the opening.

* * * * *